United States Patent [19]

Beckert et al.

[11] 4,234,178

[45] Nov. 18, 1980

[54] PROCESS AND APPARATUS FOR THE PRODUCTION OF BOOK BLOCKS

[75] Inventors: Alexander Beckert, Vienna, Austria; Ernst Dudziak, Harsewinkel, Fed. Rep. of Germany

[73] Assignee: Reinhard Mohn GmbH, Gutersloh, Fed. Rep. of Germany

[21] Appl. No.: 940,978

[22] Filed: Sep. 11, 1978

[30] Foreign Application Priority Data

Sep. 14, 1977 [DE] Fed. Rep. of Germany ..... 2741332

[51] Int. Cl.[3] ..... B42C 1/00

[52] U.S. Cl. ..... 270/45; 270/12; 270/18; 270/51; 270/58

[58] Field of Search ..... 270/4, 5, 16, 18, 21, 270/45, 32, 51, 58, 37, 8, 46, 9, 12, 17, 20, 81-86, 93-94

[56] References Cited

U.S. PATENT DOCUMENTS

| | | | |
|---|---|---|---|
| 1,793,553 | 2/1931 | Kast | 270/58 |
| 3,054,612 | 9/1962 | Godlewski | 270/58 |

*Primary Examiner*—Eugene H. Eickholt

*Attorney, Agent, or Firm*—Friedman, Goodman & Teitelbaum

[57] ABSTRACT

A process and apparatus for the production of a book block, including sheet feeders disposed in series alongside a continuously running, transversely inclined conveyor belt, so that the sheets are successively fed from the feeders and successively disposed one upon the other on the conveyor belt to form a packet. Each sheet is first conveyed from its associated feeder at a downwardly inclined angle, and in a transverse direction with respect to the conveyor belt, and thereafter accelerated at another downwardly inclined angle and in the direction of the conveyor belt to obtain the conveyor belt speed for deposit thereon. From the conveyor belt, the packets are perforated, aligned, cut into strips and again aligned, all of which being performed at the same inclined angle as the conveyor belt. The strips are then folded and cut into quires. The quires are scaled off and then thrust together and thereupon gathered into the book block blank. Fold bands convey the folded strips in an upright standing position into conveyor belts which are disposed in a fan-like arrangement in order to feed the folded strips into the quire cutting station. The stations positioned after the conveyor belt are disposed in a horizontal arrangement to provide for alignment of the packets and the strips.

22 Claims, 4 Drawing Figures

PROCESS AND APPARATUS FOR THE PRODUCTION OF BOOK BLOCKS

The invention relates to a process for the production of a book block of printed sheets as well as to an apparatus for the execution of the process.

The process for the production of a book block is dependent on the preceding printing process. Theoretically a distinction is drawn between the sheet-printing and the roll printing process. While for roll printing processes there have been developed processes for the continuous automatic production of book blocks that operate at a high speed, this has not been successfully accomplished in the production of book blocks of printed sheets. The sheets coming from the sheet-printing machine are, according to the conventional process, stacked on pallets, from the pallet each sheet is individually drawn off, folded into the quire, the quires are intermediately stacked, several different quires are gathered to form the book block blank and thereupon, for example, an adhesive binding is carried out. There a great deal of manual labor accures that considerably retards the process.

The known roll printing processes with continuous automatic book block production operate, to be sure, very rapidly, but are not available for all printing processes—relief printing, surface printing and intaglio printing—, are difficult in the control, frequently not sufficiently variable in format and overlays, are strongly influenced by fluctuations of the paper thickness, make possible the use of quarter-sheets only with considerable expenditure, and, above, the adding of, for example, multicolor sheet parts is precluded, which is frequently required.

The sheet printing process with subsequent production of book blocks, in contrast does not present in particular these disadvantages, but is frequently unusable because the manual labor and the low operating speed make the process uncompetitive.

The problem of the invention, therefore, is to provide a process and an apparatus which permit the automatic continuous production of book blocks of printed sheets, which are variable in format and overlay and operate at a high speed independently of the preceding printing process.

This problem is solved according to the invention by a process for the production of a book block of several different printed sheets which is distinguished in that the various printed sheets are laid one upon another to form a sheet pack, there aligned and thereupon fixed in position among one another, the packet is then cut in strips, the strips folded in funnel form preferably centrally in the longitudinal axis and then transversely cut into quires, the quires possibly scaled off and then thrust together to form the book block blank, which is further processed in a manner known per se into a book block.

In the execution of the process according to the invention, the printed product after formation of the pack can be at rest in the further processing; the requisite tools are correspondingly transported. It is also possible, however, for only a part of the tools and the sheets and/or the packet and/or the strips and/or the strips and/or the quires to be partially transported.

The process can be realized especially advantageously if the printed product is continuously transported and the tools operate in stationary position. In this case it is possible to stack the printed sheets of a printing machine on a pallet and to feed the pallet to a feeder, to coordinate several feeders in correspondence to the number of sheets required for the production of the book block and with the feeders to lay the sheets one after another on a continuously running transport means, for example an endless belt or the like, to form a packet. The packet is then conveyed onward for the positional fixing of the sheets with suitable means, there the sheets are pasted in parallel lines of a preselected spacing in transport direction and/or grooved and/or perforated and/or wire-stitched and/or thread-stitched and then the packet is longitudinally cut into strips in transport direction in parallel lines of a preselected spacing between the lines for the positional fixing. The strips are thereupon folded in the lines for the positional fixing, preferably in funnel form with a funnel pointing downward or to the sides, the folded strips are then transversely cut into several quires, scaled out and thrust together to form the book block blank. Thereupon an end paper can be supplied and glued to the title and/or wear sheet, after which there takes place the adhesive binding, drying, three-knife trimming and palleting.

According to a special embodiment of the invention several feeders are arranged in a series laterally beside a conveyor belt inclined transversely to the conveyance direction, the belt being inclined to the side turned away from the feeders. There the feeders in a predetermined rhythm supply one sheet each laterally to the conveyance system to form the print sheet packet. This process variant serves especially for the aligning of the print sheets, which after leaving the feeder, as a result of the inclination of the conveyor belt, slip against a laterally arranged edge provided for them and thus are aligned with a side edge. The further aligning takes place in a manner known per se according to the print or draw mark of the sheet. It is also possible, however, to align the rear edge of the packet by thrust elements, so that by two edges, a side edge and the rear edge, the sheet packet is aligned to the required extent for the subsequent operations for the positional fixing and the cutting. Between the positional fixing and the cutting of the packet, if need be, the packet can be aligned in a manner known per se with rollers resting on the packet disposed obliquely to the conveyance direction. It is advantageous after the lengthwise cutting to convey each strip individually, preferably in a conveyance means of box type inclined correspondingly to the conveyor belt, preferably constructed as an angle plate, in which process it slips with one lengthwise cut edge against a box side wall and aligns itself automatically. A further alignment can take place in a manner known per se with applied rollers, but is necessary only if running faults of the conveyance means have to be compensated.

For the stacking, supporting and aligning of the sheets or of the packet of the sheets on the conveyor belt preferably grippers are used, which operate in alternation in such a manner that one pair of grippers holds the sheet or the packet, after feeding in of a new sheet and gripping of a new gripper pair opens and returns into the starting position in order again to grip the next sheet or the next packet.

The new process comprises a substantial techanical advance. Relief-printing, and/or surface-printing and/or intaglio-printing sheets can be continuously and automatically further processed into a book block. The process brings about not only the integration with a printing machine, but makes it possible, in particular, to combine the most diverse print products into the book block. The speed of the operating course can be chosen and controlled at will. The variablility of format is yielded from the simple adjustability of the means, in part known per se, used for the execution of the process. This holds likewise for the variability of edition. Fluctuations in paper thickness do not make themselves troublesomely noticeable in the book block, because products of different printing machines and thereby statistically different printing sheet thicknesses can be combined with one another. A substantial advantage lies in the possibility of the processing of, for example, a quarter sheet which is supplied preferably as the last sheet to the sheet packet. Further, the adding of print products of alien nature, such as, for example, multicolor printed sheets is feasible without problems at any desired place. This can take place in the assembling of the packet, but also still in the assembling of the quires. Since individual sheets are processed for the production of the book block, the control of the print quality can be carried out in the manner known per se on each sheet-printing printing machine and, therefore, at an earlier point of time sheets of inferior print quality can be prevented from being guided into the corresponding feeder.

With the aid of the drawing process according to the invention, as well as an apparatus for the execution of the process, is explained in detail by way of example.

Figure 1:
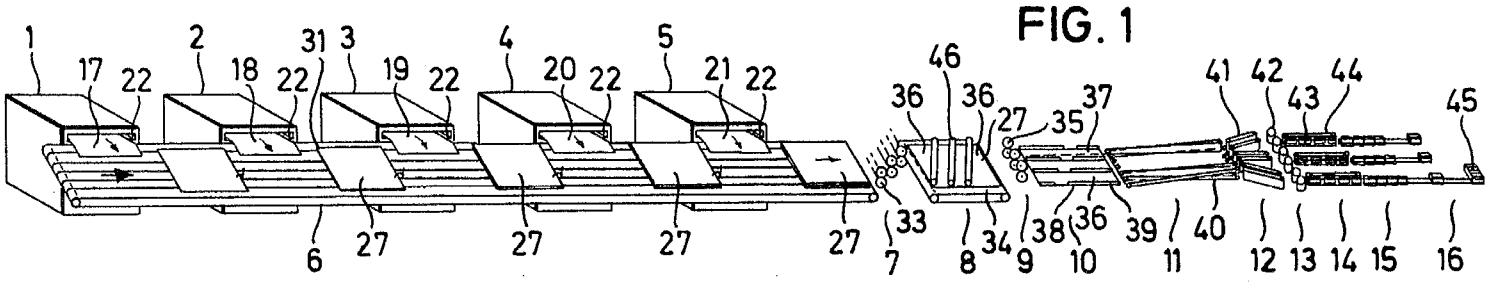
FIG. 1 shows a schematic perspective representation of the apparatus.
Figure 4:
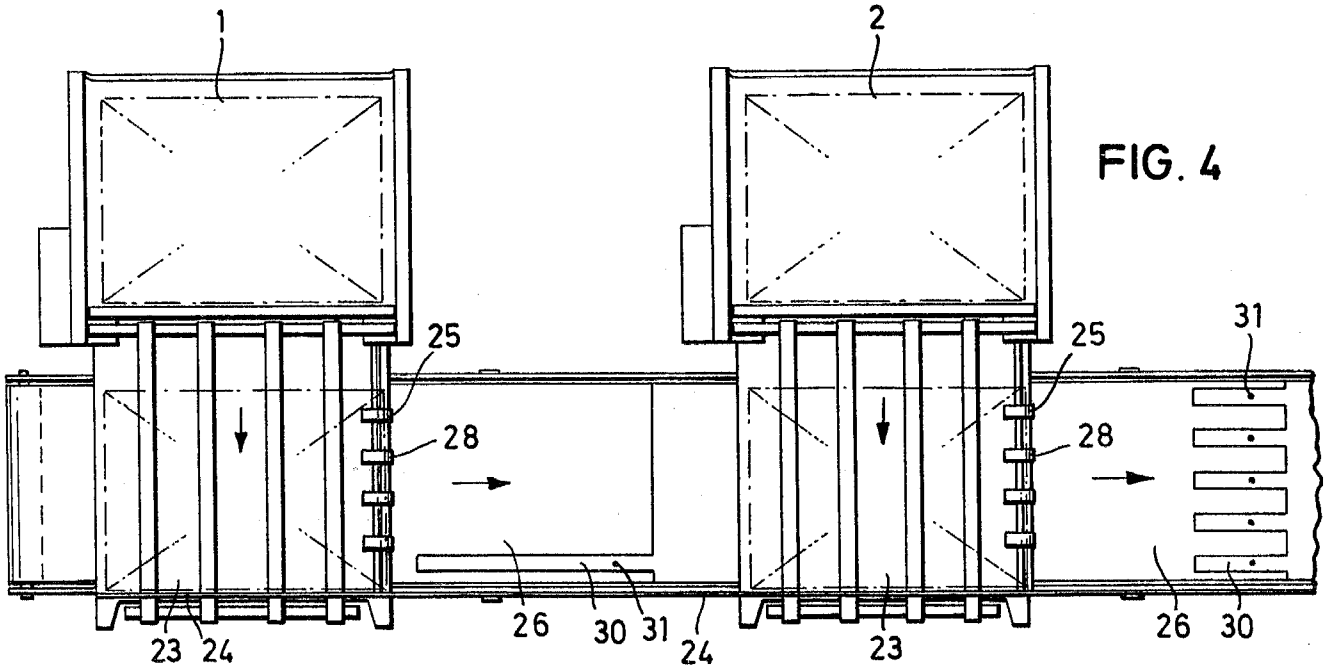
FIG. 4 shows a plan view of the feeder according to FIG. 3.
Figure 2:
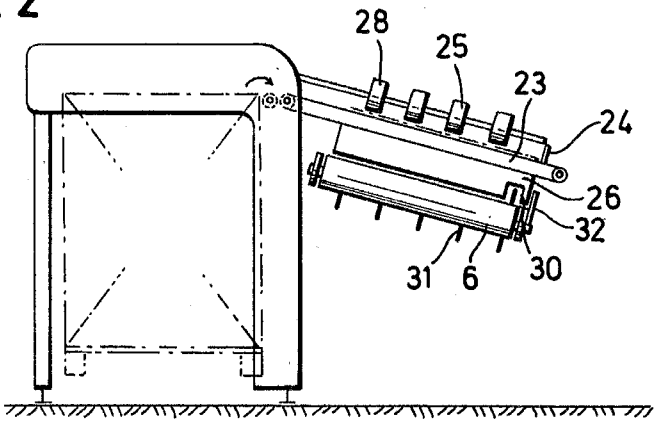
FIG. 2 shows a view in conveyance direction of a feeder with conveyance means.

The apparatus according to the invention consists of the feeders 1 to 5, the conveyor belt 6, the perforation station 7, the aligning band 8, the cutting station 9, the boxlike conveyance means 10, the folding station 11, the distributor station 14 as well as the scaling-off station 15 and the collecting station 16.

The feeders 1 to 5 are filled with sheets stacked on pallets. Each feeder feeds in the desired rhythm a sheet 17 to 21 to the conveyor belt 6, without the belt having to be stopped for this operation. The feeders are in series one after the other in conveyance direction beside the conveyor belt, the sheet gaps 22 point to the conveyor belt and the sheets are fed transversely to the conveyance direction of the belt 6. Obviously it is also possible to arrange the feeder over, in particular, however, also under the conveyor belt 6 and to provide the sheet gap 22 in such a way that the sheet in conveyance direction is fed directly from the gap. In the case of the arrangement under the conveyance means, the conveyance means may consist of several short bands arranged in succession with an interspace or gap through which the sheets are conveyed from the respective feeder onto the conveyance means.

The conveyor belt 6 is arranged inclined transversely to the conveyance direction, the inclination running downward away from the feeders and the angle of inclination being adjustable, and thereby it can be adapted to the respective sheet material.

Figure 3:
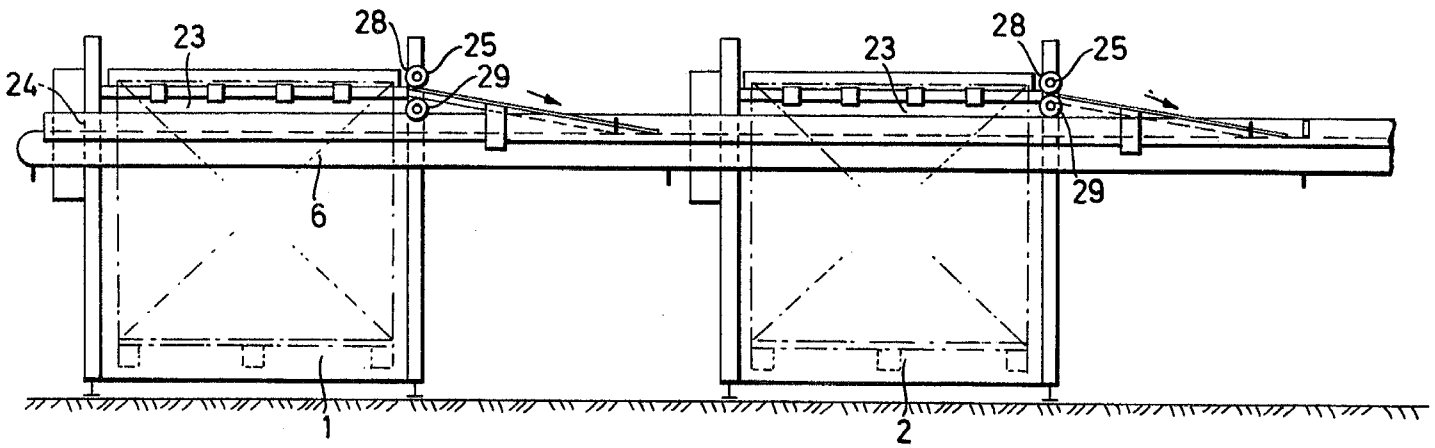
FIG. 3 shows a partial side view of two combined feeders.

Each feeder 1 to 5 presents in front of the sheet gap 22 a conveyance means 23 correspondingly inclined to the conveyor belt 6, and consisting preferably of several bands arranged parallel to one another, which conveyance means is arranged over the conveyor belt 6 and conveys a sheet from the feeder transversely to the conveyance direction of the band 6. In the zone of the edge of the belt 23 lying in transport direction of the belt 6 there are arranged timing rolls 25, which in rhythm grip the sheet conveyed transversely by the belt 23 and convey it in conveyance direction accelerated over an oblique surface 26 inclined to the conveyor belt 6 and transversely thereto so that the sheet in being deposited on the conveyor belt 6 or the sheet packet 27 has the same velocity as the conveyor band 6. The timing rolls consists preferably of upper rolls 28 and counter-rolls 29, which are in open position in the transverse conveyance of the sheet (FIG. 3, lefthand side) and in their own conveying position are closed (FIG. 3, righthand side).

The oblique surface 26 may consist of several solid bands arranged parallel to one another with interspaces, the bands facing in transport direction of the belt 6. They may also, however—as represented—be constructed as a surface with slits 30. In this case the slits 30 serve not to hamper the free run of the thrust elements 31 firmly arranged on the belt 6. The thrust elements 31 stand in series adjacently transversely to the conveyance direction of the belt 6.

Over the end zone of the conveyor belts 23 there extends over the entire length of the conveyor belt 6 an aligning edge 24. Under it there is arranged in alignment a further aligning edge 32, which is arranged on the conveyor belt 6. The sheet conveyance of the above-described conveyance system runs as follows. The sheet 17 is placed by the feeder 1 on the belt 23 and conveyed up to the aligning edge 24. There it is stopped by the edge and aligned. Then the previously open timing rolls 28 and 29 close and accelerate the sheet over the oblique surface 26 until it is deposited on the belt 6 and there presents the same velocity as the belt 6. The sheet is then entrained by the belt 6 or grippers (not represented) or the thrust elements 31. In the process the thrust elements grasp already in the zone of the slits 30 behind the rear sheet edge and align the sheet, in which process—as a result of the oblique position of the belt 6—it is simultaneously aligned also on the aligning edge 32. It is, however, also possible and advantageous to align the sheet on the gripper.

The next feeder 2 operates in rhythm with its conveying elements, in which process a second sheet 18 is laid on the first sheet 17 and aligned. In this manner the exactly aligned sheet packet 27 grows on the conveyor belt 6. Especially through the inclination of the conveyor belts 6 and 23 in conjunction with the aligning edges 24 and 32 arranged one over the other, aligning in conveyance direction, there is provided the possibility of aligning the sheet packet in the required way for the subsequent operations. There the aligning of a further edge can take place instead of with the thrust elements, advantageously with grippers that operate in alternation in such a way that one or two grippers are allocated to a feeder system, these grippers orient themselves according to the draw marks on the front edge of the sheet, like, for example, the grippers in the printing machine, after the transverse conveyance and acceleration of the sheet in conveyance direction grip the sheet aligned on the gripper and convey it onto the band to the next feeder, there open, simultaneously transfer it to the corresponding gripper pair after depositing the next sheet and return. There it is advantageous if the belt 6 consists of several parallel-disposed narrow bands and thereby an interspace can be used for the arrangement and the movement courses of the respective gripper system.

Stations 7-16 are described below, however, it is understood that the process and apparatus used in these stations are in part well known in the art, as indicated below. Therefore, a full description of how the packets 27 are conveyed, cut and folded in these stations 7-16 to form the book blocks is not thought necessary. Accordingly, only those adjustments or modifications of the prior art lying within the scope of the present invention will be set forth below so as to enable any person skilled in the art to which it pertains, or with which it is most nearly connected, to make and use the present invention.

The sheet packet 27 which may be treated between the feeder stations with brushes for the sweeping out of the air between the sheets (not represented), passes into the perforation station 7. For this, transfer rollers are provided (not represented), which convey the packet also through the perforation rollers, such transfer rollers being well known in the art. In the perforation station there are arranged perforation rolls 33, known per se, which perforate the sheets of the sheet packet, previously lying loosely on one another—as represented—in conveyance direction and thereby fix them in position among one another. There the perforation rolls 33 are arranged staggered in succession in conveyance direction, in order to have available the required space for several perforation roll pairs. The roll pairs are adjustable both transversely and also in conveyance direction and are thus adjustable for various formats. In like manner it is advantageous to provide an axis with individually adjustable perforating fittings.

After the lengthwise perforation, the packet presenting the perforation lines 36 is further transported on a band 34. There—as represented—and, if necessary, an alignment can take place with obliquely set brush rollers 46 in a manner in itself known. Transfer rollers (not represented) are again used to transfer the packet to the cutting station 9, which is equipped with cutting roll fittings, in themselves known. The cutting roll fittings are preferably arranged staggered and are adjustable in the same manner as the perforation rolls. They may, however, be arranged individually adjustable on one axis. The cutting roll fittings cut the packet between the perforation lines 36 into strips 37. The strips 37 are conveyed in a suitable manner within the angle plates 38 of the boxlike conveyance means 10, as they are both aligned and conveyed onward with suitable means, as set forth below. There, for the alignment there may serve an edge 39, against which the strips slip because of the inclined arrangement of the boxes corresponding to the inclination of the conveyor belt 6 and are thereby aligned. Preferably all the preceding stations, inclusive of the angle plates, are arranged inclined in correspondence to the inclination of the conveyor belt 6. In the angle plates, the strips can be conveyed with a band, grippers or thrust pins, all of which are known in the art.

The strips 37 are conveyed, by suitable means known in the art, from the boxlike angle plates 38 into the folding station 11. There they are provided, along the perforation lines in a manner known per se, with a downward-directed funnel fold, for which fold bands 40 serve. The fold bands convey the upright standing folded strips into correspondingly aligned, perpendicularly standing conveyor belts 41 at the conveyance station 12. The belts 41 are arranged in fan form in conveyance direction and fan out—as represented—the strip in respect to the running direction in order to feed the strips into the transverse cutting station 13. In this station there are provided transverse-cutting cutter rollers 42 standing upright, which cut the upright conveyed strips 37 into quires 43. The quires are conveyed between upright standing conveyor belts 44 of the distributor station 14 to the scaling-off station 15, which in a manner in itself known, they are scaled off with known means, then thrust together and thereupon—as represented—gathered into the book block blank 45. The further processing for the production of the adhesive binding takes place likewise in a known manner and is not an object of the invention. It lies within the scope of the invention to carry out the folding in such a manner that the folded strips are further processed while lying flat. There the subsequent tools are set for material lying flat.

It does, however, lie within the scope of the invention to arrange the stations after the conveyor belt 6 horizontally and to provide them with corresponding means for an alignment of the packet or of the strips. Further, it is possible to carry out the positional fixing with glue strips, which, for example, can be applied in the printing or in the feeder, it being possible to carry out the cementing with thermoadhesive adhesives, which after application immediately harden and can again be made sticky by supplying of heat in a station corresponding to the perforation station. It is possible, furthermore, to transport the folded strips onward horizontally, and to cut them and further process them in this position.

The format and edition variability of the apparatus represented by way of example is obvious. Each stage can be adjusted for a certain format. Furthermore, the number of feeders can be chosen at will and thereby the thickness of an overlay can be varied. The process and the apparatus according to the invention have, accordingly, all the advantages of modern roll printing machines, but over, moreover the advantages, however, of producing a book block from individually printed sheets.

We claim:

1. Process for production of book blocks of printed sheets comprising:

providing a plurality of stacks of printed sheets in series, one after another, alongside a continuously running, transversely inclined conveyor belt;

successively feeding one sheet from each stack, one upon another, to form a sheet packet on said conveyor belt, each sheet firstly being fed at a downwardly inclined angle from its stack and in a transverse direction to the running direction of said conveyor belt, and each sheet secondly being accelerated in the running direction of said conveyor belt to obtain same speed as said conveyor belt with a first of the sheets being deposited on said conveyor belt and successive sheets being deposited on a previously deposited sheet to provide the packet, each sheet being downwardly inclined toward said conveyor belt during acceleration and before depositing thereof on said conveyor belt;

continuously forming sheet packets on said conveyor belt so that a finished packet is disposed at one end of said conveyor belt when another packet is first starting to be formed at an opposite end of said conveyor belt, with a number of unfinished packets being disposed therebetween on said conveyor belt;

cutting each finished packet into parallel strips;

centrally folding each of said strips from each finished packet along its longitudinal axis;

transversely cutting each of the folded strips from each finished packet into quires;

scaling off said quires from each finished packet; and gathering said scaled off quires from each finished packet into a book block blank.

2. Process according to claim 1 including aligning each sheet on one edge thereof during the formation of the packet on the conveyor belt.

3. Process according to claim 1 including aligning each sheet on two edges thereof during the formation of the packet on the conveyor belt.

4. Process according to claim 1 including perforating each finished packet to provide lengthwise perforations, and aligning the perforated packet prior to cutting the packet into strips so that each strip has one lengthwise perforation therein parallel to the cut edges of the strip.

5. Process according to claim 4, wherein said folding of said strips is performed along the lengthwise perforation in a funnel form, and including conveying the folded strips in an upright vertically standing position for the transverse cutting thereof.

6. Process according to claim 5, wherein a portion of the folded strips are fanned out laterally at an acute angle relative to each other before the transverse cutting thereof.

7. Process according to claim 6, wherein the quires are scaled off in an upright perpendicularly standing position, and the scaled off quires of all the strips from each finished packet are thrust together to form the book block blank.

8. Process according to claim 1 including aligning each of the strips on one longitudinal edge thereof as the strips are being continuously conveyed before the folding thereof.

9. Process according to claim 1 including conveying both the packets and the strips at a transversely inclined angle prior to the folding of the strips.

10. Process according to claim 1 including successively gripping the sheets on the conveyor belt during the forming of the packet for conducting and aligning the sheets on the conveyor belt between the stacks.

11. Apparatus for production of book blocks of printed sheets comprising:

a continuously running, transversely inclined conveyor belt;

a plurality of feeder means for successively feeding one sheet of a stack from each feeder means, one upon another, to provide a sheet packet on said conveyor belt, said feeder means being disposed in series, one after another, alongside said conveyor belt;

each feeder means including conveyor means for feeding a sheet from its stack at a downwardly inclined angle in a transverse direction to the running direction of said conveyor belt;

each feeder means further including an oblique surface member disposed at a downwardly inclined angle between said feeder conveyor means and said conveyor belt;

each feeder means still further including timing means for accelerating each sheet, from said feeder conveyor means and across said oblique surface member, to the running speed of said conveyor belt for deposit on said conveyor belt with a first of the sheets being deposited directly on said conveyor belt and successive sheets being deposited on a previously deposited sheet to form the packet;

said feeder means selectively feeding said sheets to continuously form sheet packets on said conveyor belt with a finished packet being disposed at one end of said conveyor belt when another packet is being started at an opposite end of said conveyor belt, a number of unfinished packets being disposed therebetween on said conveyor belt;

perforation means disposed adjacent said one end of said conveyor belt for perforating each finished packet to provide spaced apart lengthwise perforations therein;

first cutting means disposed after said perforation means for cutting each perforated packet into parallel strips each having one of said lengthwise perforations centrally disposed therein;

folding means disposed after said first cutting means for centrally folding each of said strips along its lengthwise perforation;

second cutting means disposed after said folding means for transversely cutting each of said folded strips into quires;

scaling off means disposed after said second cutting means for scaling off said quires; and collecting means disposed after said scaling off means for gathering said scaled off quires from each finished packet into a book block blank.

12. Apparatus according to claim 11, wherein said timing means includes upper rolls and lower counterrolls disposed between said feeder conveyor means and said oblique surface member, said upper rolls being mounted over a side edge of said feeder conveyor means for engaging a sheet disposed on said feeder conveyor means to transfer same to said oblique surface member.

13. Apparatus according to claim 11, wherein first aligning edge means are disposed at an end of said feeder conveyor means for aligning a sheet thereon, and second aligning edge means are disposed along entire length of said conveyor belt for aligning the sheets deposited thereon.

14. Apparatus according to claim 11, wherein said oblique surface member is provided with parallel slits therein, and said conveyor belt is provided with thrust elements transversely disposed in standing series for engaging and aligning the sheets deposited on said conveyor belt, said thrust elements passing through said parallel slits in said oblique surface member.

15. Apparatus according to claim 11, wherein said perforation means includes perforation rolls disposed in a staggered arrangement with respect to each other, said perforation rolls being inclined at the same angle as said conveyor belt.

16. Apparatus according to claim 11, wherein aligning means are disposed between said perforation means and said first cutting means for aligning said perforated packet prior to cutting thereof, said aligning means including an inclined conveyor belt and brush rollers disposed thereover.

17. Apparatus according to claim 11, wherein said first cutting means includes inclined cutting rolls.

18. Apparatus according to claim 11, wherein boxlike conveyance means are disposed between said first cutting means and said folding means for aligning said strips, said boxlike conveyance means includes angle plates disposed at an inclined angle.

19. Apparatus according to claim 11, wherein said folding means includes folding bands for conveying the folded strips in an upright standing position.

20. Apparatus according to claim 19, wherein perpendicularly standing conveyor belts are disposed in a fanned out arrangement for conveying said upright standing folded strips to said second cutting means.

21. Apparatus according to claim 20, wherein said second cutting means includes cutter rollers standing upright for transversely cutting said upright standing folded strips.

22. Apparatus according to claim 21, wherein said scaling off means includes upright standing conveyor belts for conveying the quires.

* * * * *